United States Patent [19]

Hudgins

[11] Patent Number: 4,880,146

[45] Date of Patent: Nov. 14, 1989

[54] DROP DISPENSER WHICH AUTOMATICALLY STIRS THE CONTENTS OF THE DISPENSER WHEN THE CAP IS REMOVED

[76] Inventor: J. S. Hudgins, 321 Harbor Pointe Dr., #14, Mt. Pleasant, S.C. 29464

[21] Appl. No.: 203,939

[22] Filed: Jun. 8, 1988

[51] Int. Cl.[4] ..... B67D 5/06

[52] U.S. Cl. ..... 222/192; 222/420; 222/562; 366/247; 366/308; 604/295; 604/903

[58] Field of Search ..... 222/182, 206, 207, 215, 222/212, 228, 229, 420, 421, 546, 562, 192; 366/244, 245, 247, 308, 130; 604/295, 296, 300, 212, 216, 903

[56] References Cited

U.S. PATENT DOCUMENTS

| | | | |
|---|---|---|---|
| 1,111,374 | 9/1914 | Goddard | 366/308 |
| 2,520,605 | 8/1950 | Maynier | 604/295 X |
| 3,204,283 | 9/1965 | Damron | 366/244 X |
| 3,209,387 | 10/1965 | Lukesch | 366/247 X |
| 3,606,276 | 9/1971 | Jackson | 366/130 |

FOREIGN PATENT DOCUMENTS

| | | | |
|---|---|---|---|
| 960609 | 1/1975 | Canada | 366/308 |
| 600251 | 11/1959 | Italy | 366/308 |

*Primary Examiner*—Kevin P. Shaver
*Assistant Examiner*—Edward S. Ammeen
*Attorney, Agent, or Firm*—Larson and Taylor

[57] ABSTRACT

An improved drop dispenser comprised of a container having a threaded cap and a drop nozzle/impeller assembly positioned inside said container. The cap has a receiving orifice which receives and engages the end of drop nozzles so that when the cap is removed by unscrewing, the nozzle/impeller assembly is rotated to stir the contents of the container.

14 Claims, 2 Drawing Sheets

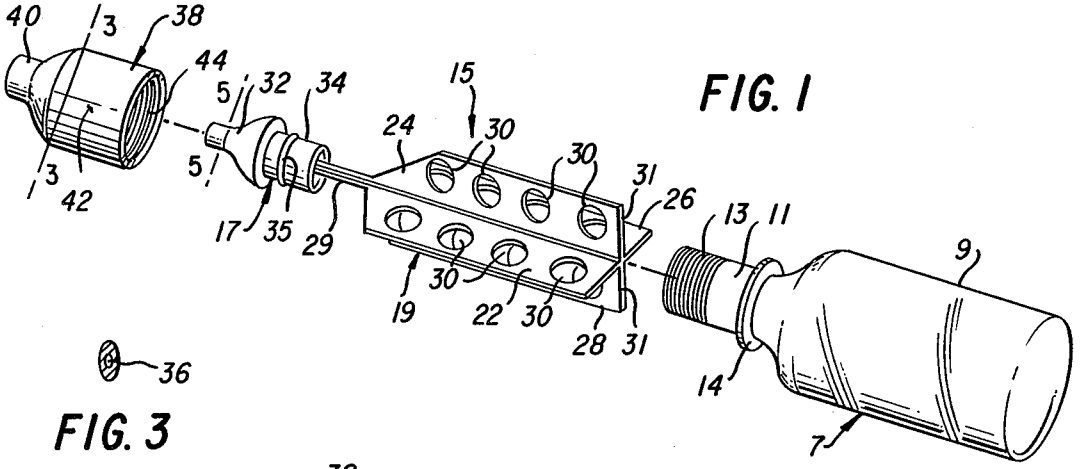
FIG. 1
FIG. 3
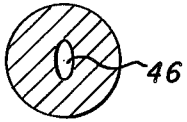
FIG. 2
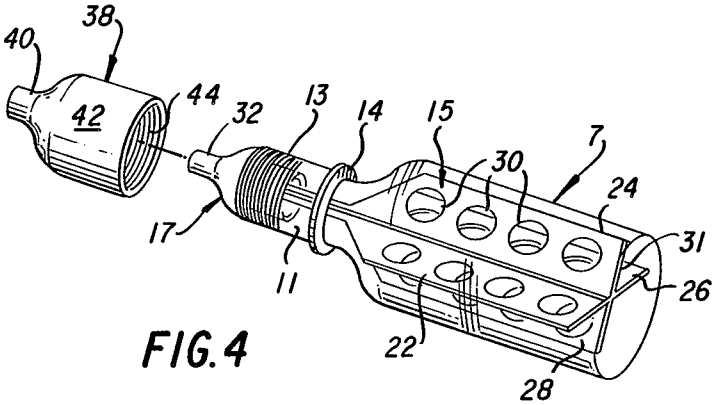
FIG. 4

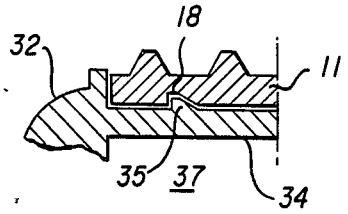
FIG. 6
FIG. 5
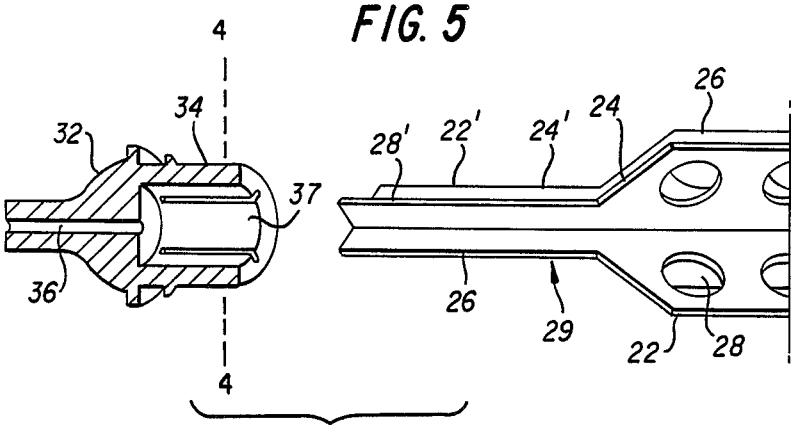
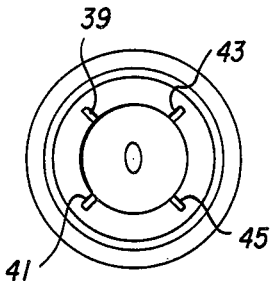
FIG. 7

DROP DISPENSER WHICH AUTOMATICALLY STIRS THE CONTENTS OF THE DISPENSER WHEN THE CAP IS REMOVED

BACKGROUND OF THE INVENTION

This invention relates to an improved drop dispenser. More particularly, the invention relates to an eye or ear drop dispenser which automatically stirs the contents of the dispenser when the cap is removed.

Ocular or otic medications in drop form are typically prepared in either solutions or suspensions of the active ingredient and a suitable liquid vehicle. In many cases, the medication, when prepared as a suspension, has a greater bioavailability and is more effective than the same medication prepared as a solution. However, unlike solutions, suspensions tend to settle with time and must be shaken well before use to provide uniform distribution of the drug in its medium.

In a perfect world, this would not be a problem—patients would shake their eye or ear drops well before each use and the composition of the last drop would mirror that of the first. In reality, patients forget to shake their drops some or all of the time, or were never told to shake them, or don't shake them enough. Consequently, the patent receives more or less of the medication than their doctor intended.

This is a significant problem for both the health of the patient's eyes or ears and the economic health of the companies that produce eye or ear drops in suspension form. A good example is that of corticosteroids—one of the most commonly used groups of ocular or otic medications. Numerous studies have shown the superiority of topical delivery as a suspension. However, many ophthalmologists and otologists prescribe the drugs in solution form because they know patients will not properly shake the suspension preparations prior to use. The advertising information for the solution preparations stress the fact that they do not have to be shaken. Manufacturers of the suspension forms of corticosteroids, antibiotics and combination products would welcome an inexpensive and reliable way of insuring their drops are well mixed when used.

It is an object of the invention, therefore, to provide a reliable and economic means for insuring that ocular or otic medications in suspension form are well mixed prior to use.

SUMMARY OF THE INVENTION

The foregoing objectives are achieved by an improved drop dispenser comprising (i) a container having an externally threaded portion at its open end; (ii) a nozzle/impeller assembly comprised of a drop nozzle rotatably connected to an impeller mixing means, said impeller mixing means being positioned inside said container and at least a portion of said drop nozzle extending beyond the open end of said container; (iii) an opening through the drop nozzle providing communication between the inside and outside of said container; and (iv) a cap having internal threads for threaded engagement with the external threads of said container and means receiving and engaging the end of said drop nozzle so that when said cap is unscrewed, the nozzle/impeller assembly is rotated. In a preferred embodiment, the end of the drop nozzle has an oval cross-section and the means in the cap for receiving and engaging the end of the drop nozzle being an oval of cross-section permitting receipt of the drop nozzle end.

BRIEF DESCRIPTION OF THE DRAWINGS

The invention will be more clearly understood from the following detailed description when taken in connection with the following drawings which show by way of example a preferred embodiment of the invention. While the following description relates to an ophthalmic drop dispenser, it should be understood that the invention is broadly applicable to other dispensers of medications in drop form where prior mixing is necessary or desirable, such as dispensers of otic and other topical drops.

IN THE DRAWINGS:

FIG. 1 is an exploded view in perspective of the improved eye drop dispenser of the invention;

FIG. 2 is a cross-section taken along lines 3 and 3' of the cap shown in FIG. 1;

FIG. 3 is a cross-section taken along lines 5 and 5' of the end of the nozzle section of FIG. 1;

FIG. 4 is an assembled view in perspective of the improved eye drop dispenser of the invention, with the cap thereof about to be screwed on;

FIG. 5 is an exploded side elevation of the nozzle/impeller prior to assembly within the nozzle in section;

FIG. 6 is a partial cross-sectional view of the nozzle secured to the neck of the bottle; and FIG. 7 is a cross-section taken along lines 4—4' of FIG. 5.

DESCRIPTION OF THE PREFERRED EMBODIMENT

Referring to FIGS. 1–6, the improved eye drop dispenser of the invention is comprised of a container such as a bottle designated generally as 7 comprised of a main body portion 9 and a neck portion 11. Neck portion 11 is provided with external threads 13. It will be discussed further below the number of threads on neck 11 which will determine the extent of stirring automatically accomplished by the eye drop dispenser of the invention. Bottle 7 also contains a circumferential flange 14 which serves to strengthen the neck of the bottle and prevents drops from running down the side of the bottle. Into bottle 7 is inserted a nozzle/impeller assembly designated generally as 15 comprised of the drop nozzle and an impeller or stirrer portion. The stirrer or impeller section 19 is comprised of at least one vane or paddle section but is preferably comprised of a plurality of radial vanes 22, 24, 26, and 28, each having stem portions 22', 24', 26' and 28' joined together to form a shaft indicated generally as 29. Although the impeller as shown has four vanes, greater or lesser numbers of vanes with stems could be employed. The vanes can assume any desired shape, for instance, they may be flat or curved, continuous, intermittent, etc. Curved vanes may offer advantages in assembly of the dispenser and provide less resistance when the bottle is squeezed. If desired, the vanes can include holes 30 to assist in the stirring action accomplished by the impeller assembly. Also, loading of the nozzle/impeller assembly into the bottle 7 may be facilitated by angling inwardly a few degrees the ends 31 of the vanes.

The drop nozzle 17 is composed of nose portion 32 and a cylindrical rear body portion 34 which is capable of fitting and rotating within the cylindrical neck section 11 of the bottle 7. To provide a tight leak-proof fit between nozzle 17 and bottle 7 on assembly, cylindrical rear body portion 34 of the nozzle 17 contains a ridge 35 which snaps into groove 18 on the inner wall of the cylindrical neck section 11 (see FIG. 6). Thus, on assembly, the rear body portion 34 can rotate within the neck section 11 of bottle 7 without permitting leakage from the bottle.

The end of the nose portion 32 of the drop nozzle 17 possesses an oval cross-section as shown in FIG. 3. A hole 36 in the drop nozzle extends therethrough and communicates with the bottle 7 when the rear body portion 34 of the drop nozzle 17 is positioned within the cylindrical threaded neck portion 11 of the bottle 7. As seen from FIG. 5 and FIG. 6, rear body portion 34 of the nozzle contains a chamber 37 into which hole 36 opens. The inner side walls of the rear body portion contains slots 39, 41, 43 and 45 for receipt of the stems 22', 24', 26' and 28' that make up shaft 29.

The dispenser of the invention contains a closure cap designated generally as 38 composed of an end section 40 and a body section 42 containing internal threads 44 matching the external threads 13 of bottle 7 for threaded engagement therewith. The inside of the cap end section 40 contains a female receiving orifice, oval in shape which receives and engages nose portion 32 of nozzle 17 so that when the cap is rotated the nozzle/impeller assembly also rotates in concert therewith. It should be understood that the receiving means 46 and the nozzle nose portion may take a variety of different shapes and sizes, many of which will come immediately to mind to those skilled in the art, so long as the receiving orifice 46 of the cap accommodates and engages the nose portion 32 of the nozzle 17 in a fashion that permits rotation of the cap and the nozzle/impeller means in concert.

The novel dispenser of the invention can be constructed of any suitable material, but most advantageously it is manufactured from a suitable flexible plastic material such as polyolefin, polystyrene, polyester, polyvinyl acetate, and the like. In most instances, the impeller or stirrer means 15 will be fashioned from a thin, flexible plastic material that facilitates insertion into the bottle 7.

To assemble the eye drop dispenser of the present invention, the stems 22', 24', 26' and 28' are inserted in slots 39, 41, 43 and 45, respectively. The flexible vanes 22, 24, 26 and 28 of the impeller 15 are twisted about each other so that the outside diameter of the vanes in a twisted state are less than the inner diameter of the neck of the bottle and quickly inserted within the bottle. Upon insertion into the bottle, the shaft 29 assumes an axial position with the vanes radiating outwardly to occupy at least a portion and preferably a substantial part of the internal area of the bottle. To complete insertion of the nozzle/assembly into the bottle, the cylindrical rear body portion 34 of the nozzle 17 is inserted into the neck section 11 until ridge 35 snaps into groove 18 around the inner wall of the neck section. Closure is completed by placing the cap 38 onto the nozzle 17 so as to allow for receipt of the nose portion 32 of the nozzle into the oval receiving orifice 46 and then screwing cap 38 onto the external threads 13 of the bottle 7. The drop dispenser is now ready for use. When the patient turns the cap so as to unscrew it, the oval cross-section inside the cap engages and turns the nozzle/impeller assembly thereby mixing the fluid within the bottle. The number of rotations the impeller makes and, therefore, the extent of mixing induced, is a function of the number of threads provided the neck of the bottle. Generally, the neck will contain 2 to 8 threads per $\frac{1}{4}$–$\frac{1}{2}$ inch. After the cap is removed, the patient uses the device to dispense fluid in dropwise fashion, just as he would with a standard eye drop bottle. In taking the cap off of the dispenser the patient has automatically mixed his medicine, producing a drop of uniform consistency.

While the features of this invention have been disclosed with reference to the specific embodiments described therein, it is to be understood that various modifications may be made in the construction without departing from the scope of the invention as defined in the appended claims.

It is claimed:

1. A drop dispenser comprising (i) a container having an externally threaded portion at its open end; (ii) a nozzle/impeller assembly comprised of a drop nozzle rotatably connected to an impeller mixing means, said impeller mixing means being positioned inside said container and at least a portion of said drop nozzle extending beyond the open end of said container; (iii) an opening through the drop nozzle providing communication between the inside and outside of said container; and (iv) a cap having internal threads for threaded engagement with the external threads of said container, means within the cap receiving and engaging the end of said drop nozzle so that when said cap is unscrewed, the nozzle/impeller assembly is rotated and means for rotatably mounting the nozzle/impeller assembly in the container which prevents the axial removal of the assembly from the container when the cap is unscrewed.

2. A drop dispenser according to claim 1 wherein the end of said drop nozzle has an oval cross section and the means within the cap for receiving and engaging the end of said drop nozzle being an oval of internal cross-section permitting receipt of the end of said drop nozzle.

3. A drop dispenser according to claim 1 wherein said impeller mixing means comprises at least one mixing vane.

4. A drop dispenser according to claim 3 wherein said at least one mixing vane is a plurality of vanes attached to a shaft.

5. A drop dispenser according to claim 4 wherein at least one of the vanes contains a plurality of holes.

6. A drop dispenser according to claim 4 wherein the edges of said vanes extend substantially to, but short of, the internal sides of the container.

7. A drop dispenser according to claim 4 wherein the impeller mixing means occupies substantially the length of the container.

8. A drop dispenser according to claim 4 wherein the impeller mixing means is constructed of a thin flexible plastic material.

9. A drop dispenser according to claim 4 wherein the vanes are flat.

10. A drop dispenser according to claim 2 wherein the cap comprises a cap end section and a body section, said body section being provided with said internal threads and said cap end section containing the means receiving and engaging the end of said drop nozzle.

11. A drop dispenser according to claim 10 wherein the container comprises a main body section and a cylindrical neck section at its open end including said external threads.

12. A drop dispenser according to claim 11 wherein the nozzle of said nozzle/impeller assembly comprises a nose portion and a cylindrical rear body portion capable of fitting and rotating within the cylindrical neck section of said container.

13. A drop dispenser according to claim 12 wherein the impeller mixing means is fixed to the rear end of the nose portion of said drop nozzle.

14. A drop dispenser according to claim 11 wherein the cylindrical neck section contains about 2 to 8 external threads per $\frac{1}{4}$–$\frac{1}{2}$ inch.

* * * * *